US005755190A

United States Patent [19]

Ronen

[11] Patent Number: 5,755,190

[45] Date of Patent: May 26, 1998

[54] RECIPROCATING MACHINE WITH COOLING JACKET

[76] Inventor: Avner Ronen, Einstein 21, 34604 Haifa, Israel

[21] Appl. No.: 751,602

[22] Filed: Nov. 18, 1996

[51] Int. Cl.[6] ..... F02F 1/10

[52] U.S. Cl. ..... 123/41.72; 123/41.81

[58] Field of Search ..... 123/41.72, 41.81, 123/193.3

[56] References Cited

U.S. PATENT DOCUMENTS

| | | | |
|---|---|---|---|
| 828,656 | 8/1906 | Huber | 123/41.81 |
| 1,292,634 | 1/1919 | Opperman | 123/41.81 |
| 1,310,913 | 7/1919 | Kirkham | 123/41.81 |
| 1,503,640 | 8/1924 | Curtiss et al. | 123/41.81 |
| 1,505,401 | 8/1924 | Mayer | 123/41.81 |
| 1,926,684 | 9/1933 | Miller | 123/41.81 |
| 2,099,852 | 11/1937 | Knudsen | 123/41.81 |
| 2,125,106 | 7/1938 | Gehret | 123/193.3 |
| 2,405,847 | 8/1946 | Pullin | 123/41.81 |

*Primary Examiner*—Noah P. Kamen
*Attorney, Agent, or Firm*—Mark M. Friedman

[57] ABSTRACT

A reciprocating machine, such as an internal combustion engine or a compressor, in which a piston slides reciprocally in a cylinder unit having an integrally formed cylinder head and cylinder body, is at least partially enclosed in a jacket. The inner surface of the jacket and the outer surface of the cylinder unit define between them a gap through which a cooling liquid may be circulated.

37 Claims, 3 Drawing Sheets

RECIPROCATING MACHINE WITH COOLING JACKET

FIELD AND BACKGROUND OF THE INVENTION

The present invention relates to machines, such as internal combustion engines and compressors, in which one or more pistons move reciprocally within cylinders. Such a machine is referred to herein as a "reciprocating machine". More particularly, the present invention relates to reciprocating machines in which the cylinder heads and cylinder bodies are formed as a single unit.

Most reciprocating internal combustion engines are constructed with a separate cylinder block and cylinder head assemblies. The cylinder head assembly typically is bolted or otherwise securely attached to the cylinder block, with a gasket between the cylinder head assembly and the cylinder block serving as a seal. One class of reciprocating internal combustion engines is constructed differently. In this class of engine, the cylinder block and cylinder head assembly are formed together as a single unit.

This uniblock design has several advantages over the conventional design. The most important advantage is that in engines of the conventional design, in which the part of the cylinders in and near the head assembly serve as combustion chambers, the stresses associated with the heat and pressure of combustion tend to concentrate in the head assembly. This tends to cause, over time, a subtle misalignment of the head assembly and the cylinder block, leading to increased wear and loss of power. In addition, in conventional engines there usually are holes, at the interface between the block and the head, to accommodate the bolts that hold the engine together, or to connect channels for cooling fluid in the cylinder block with similar channels in the cylinder head assembly. There inevitably are extra stresses associated with these holes, and both the cylinder block and the cylinder head assembly must be designed with extra thickness in these areas to accommodate those stresses. This extra thickness adds weight to the engine.

In a uniblock engine, the block and the head are a single piece. Therefore, a uniblock engine accommodates the stresses of operation more easily than an engine of conventional design. In particular, the stress and temperature distributions in a uniblock engine tend to be more uniform than the stress and temperature distributions in a conventional engine, so a uniblock engine suffers less wear than a conventional engine. In addition, a uniblock engine is lighter than a conventional engine of equivalent power.

Uniblock engines often are air-cooled. This limits their application to uses in which air cooling is sufficient. A uniblock engine may also be fabricated with channels for liquid cooling, but such an engine, like the cylinder block and cylinder head assembly of a conventional engine, must be formed by casting. Because the uniblock geometry is somewhat more complicated than the separate geometries of a conventional cylinder block and a conventional cylinder head assembly, a uniblock engine is harder and more expensive to fabricate by casting than a conventional engine.

There is thus a widely recognized need for, and it would be highly advantageous to have, a design for a liquid-cooled uniblock engine that allows the engine to be fabricated by simpler and less expensive methods than complex casting.

SUMMARY OF THE INVENTION

According to the present invention there is provided a reciprocating machine comprising: (a) at least one cylinder unit formed with a cylinder head and a cylinder body, the at least one cylinder unit having an outer wall; (b) a jacket at least partially enclosing the outer wall of the at least one cylinder unit, the jacket and the outer wall defining between them a gap; and (c) at least one piston, each of the at least one piston being reciprocally and slidably mounted within one of the at least one cylinder.

According to the present invention there is provided, in a reciprocating machine having at least one cylinder unit formed with a cylinder head and a cylinder body, the at least one cylinder unit having an outer wall and a cylinder unit flange, each of the at least one cylinder unit having a piston reciprocally and slidably mounted therewithin: the combination with the machine of a jacket at least partially enclosing the outer wall of the at least one cylinder unit, the jacket and the outer wall defining between them a gap.

According to the present invention there is provided, in a reciprocating machine having at least one cylinder unit formed with a cylinder head and a cylinder body, the at least one cylinder unit having an outer wall and a cylinder unit flange, the cylinder unit flange having a distal surface, each of the at least one cylinder unit having a piston reciprocally and slidably mounted therewithin: the combination with the machine of a jacket at least partially enclosing the outer wall of the at least one cylinder unit, the jacket and the outer wall defining between them a gap.

The innovation of the present invention is to enclose a uniblock engine in a jacket, while leaving a gap between the jacket and the engine body to accommodate a circulating coolant liquid. Both the uniblock engine body and the jacket are geometrically simple enough to be fabricated by simple casting and simple machining. Thus, the jacketed engines of the present invention may be fabricated at less expense than liquid cooled uniblock engines fabricated by casting with complex dies, especially in short production runs. In addition, if the jacket is removable, the maintenance and repair of the engine is greatly simplified compared to the maintenance and repair of a cast liquid-cooled uniblock engine.

Because the cooling passages of a jacketed uniblock engine according to the present invention are easier to fabricate than the cooling passages of a separately cast cylinder head and cylinder block, the head, the inlet port, and the exhaust port of the engine can be cooled more effectively. The improved cooling reduces the thermal stress concentration near the inlet and exhaust ports. Furthermore, because the interface between the intake and exhaust manifolds and the engine is at a relatively inexpensive jacket, rather than at a relatively expensive cast cylinder head, repairs to that part of the engine are less costly.

Although the description herein focuses on the embodiment of the present invention that is an internal combustion engine, the scope of the present invention includes all uniblock reciprocating machines, not just internal combustion engines.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a uniblock reciprocating machine that features a separately fabricated jacket that at least partially encloses the cylinder unit of the machine. A cooling liquid may be circulated in the gap between the jacket and the cylinder unit.

The principles and operation of a jacketed reciprocating machine according to the present invention may be better understood with reference to the drawings and the accompanying description.

Figure 1:
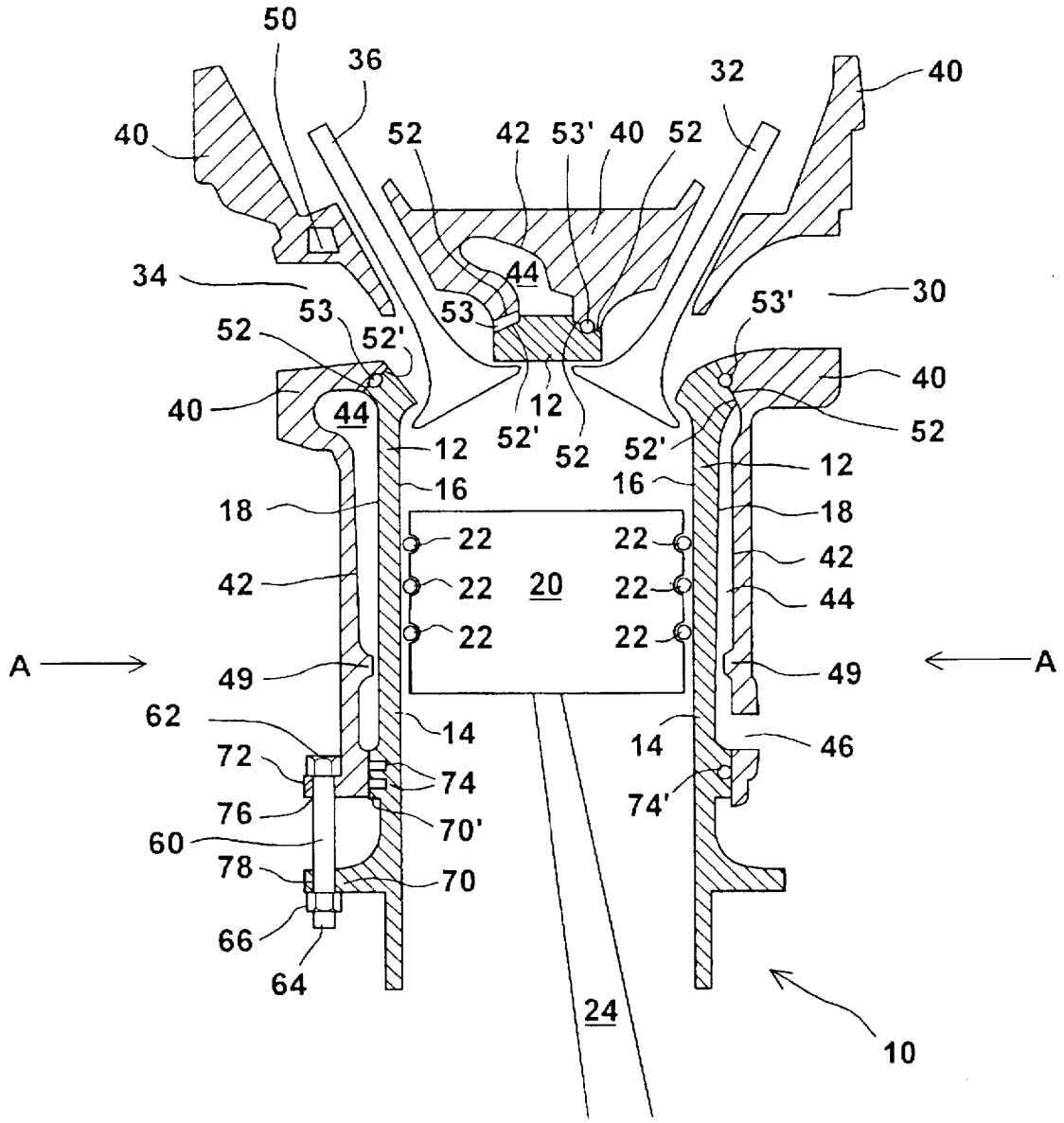
FIG. 1 is a transverse cross section through an engine according to the present invention.
Figure 2:
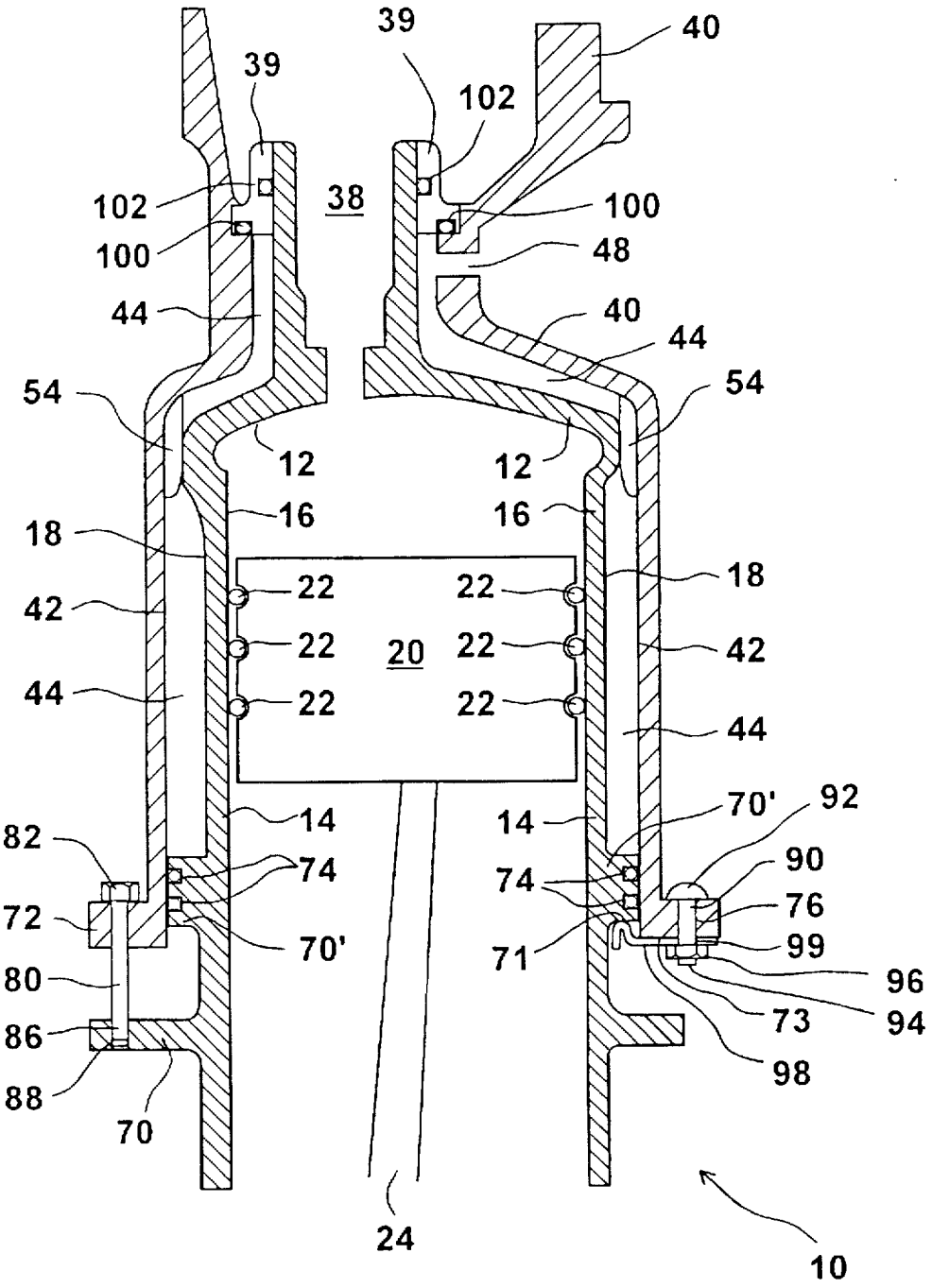
FIG. 2 is a longitudinal cross section through an engine according to the present invention.

Referring now to the drawings, FIGS. 1 and 2 are a transverse and longitudinal cross section, respectively, through an embodiment of the machine of the present invention that functions as an internal combustion engine. The engine of the Figures is a single-cylinder engine, in which a cylinder unit 10, including a cylinder head 12 and a cylinder body 14, define a cylinder within which a piston 20 slides reciprocally. The partition of cylinder unit 10 into head 12 and body 14 is a conceptual one; unit 10 actually is fabricated as a single unit. Piston 20 is provided with piston rings 22 to separate piston 20 from inner wall 16 of unit 10. Power generated by burning fuel in the combustion chamber defined by cylinder head 12 and the top surface of piston 20 is transferred to a crankshaft (not shown) by piston rod 24. The Figures show a single-cylinder embodiment of the present invention only for simplicity. The scope of the present invention includes reciprocating machines with multiple cylinder units, the cylinder units collectively constituting a cylinder block. It will be obvious to one ordinarily skilled in the art how to apply the principles, explained herein with reference to a single-cylinder engine, to multiple cylinder engines.

More specifically, the engine of the Figures is a diesel engine. Cylinder unit 10 is provided with an intake port 30 through which air is admitted to the combustion chamber by an intake valve 32, an exhaust port 34 through which spent combustion gases are allowed by exhaust valve 36 to leave the combustion chamber, and an injector seat 38 for accommodating a fuel injector (not shown).

Cylinder unit 10, piston 20, and the associated engine parts described to this point comprise an air-cooled uniblock engine of the prior art. The innovation of the present invention is the enclosure of cylinder unit 10 in jacket 40. As shown in the Figures, jacket 40 is formed in a manner that leaves a gap 44 between inner wall 42 of jacket 40 and outer wall 18 of cylinder unit 10. Gap 44 constitutes a channel through which a liquid for cooling the engine of the Figures may be circulated. Jacket 40 also is provided with an inlet 46 and an outlet 48 for the cooling liquid. Jacket 40 may also be fabricated with one or more internal channels 50 that connect to the gap and further accommodate the cooling liquid.

Figure 3B:
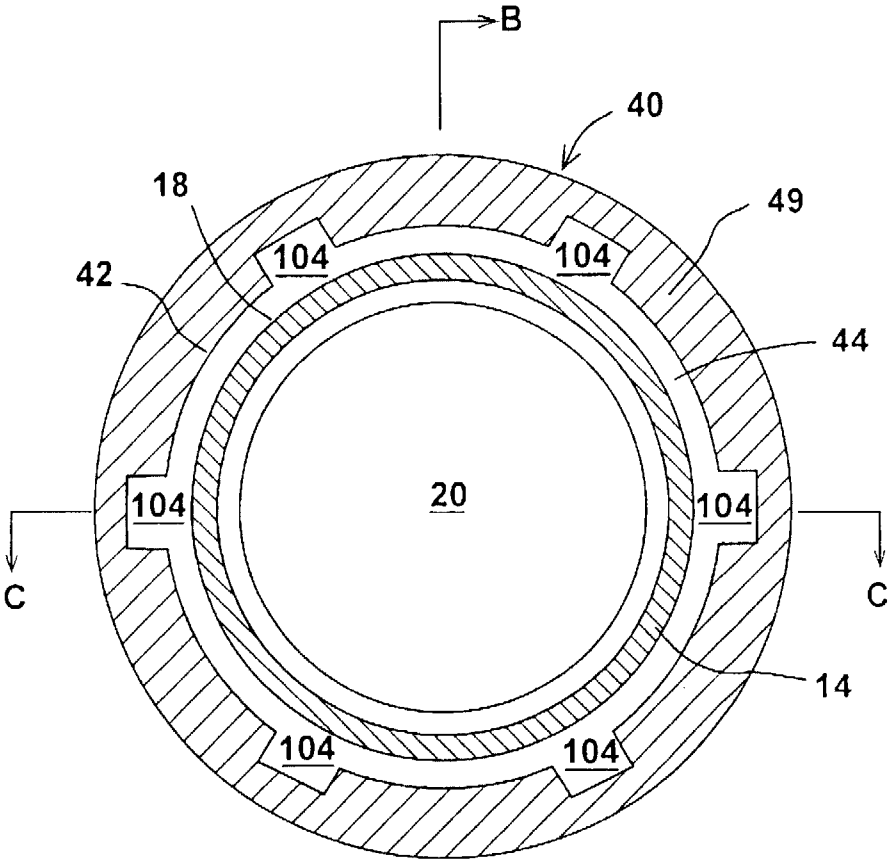
FIG. 3B is a horizontal cross section through another embodiment of an engine according to the present invention.
Figure 3A:
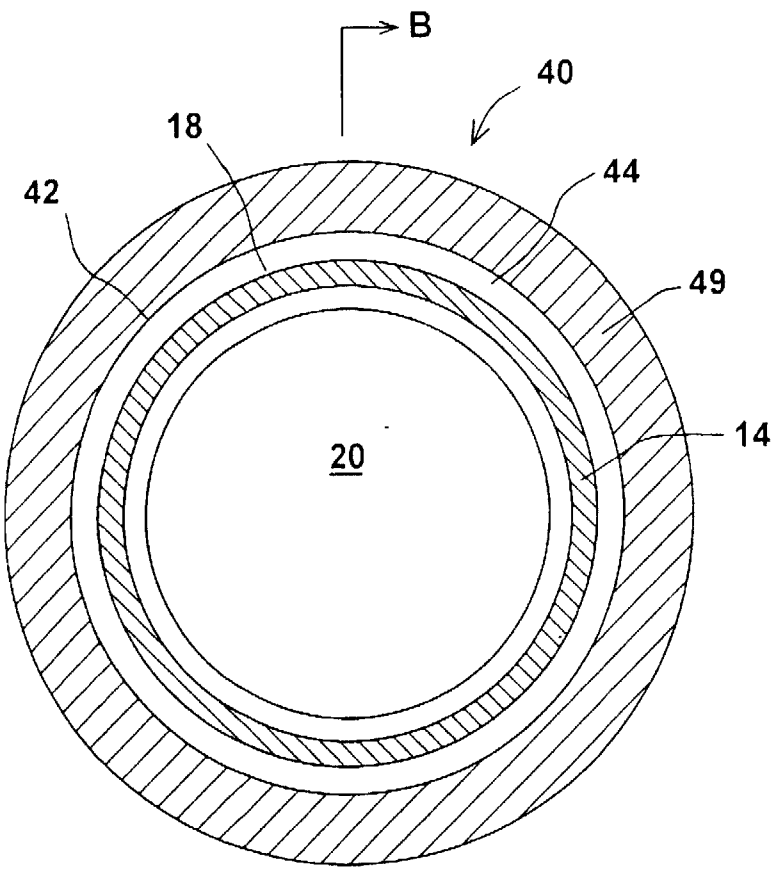
FIG. 3A is a horizontal cross section through an engine according to the present invention.

Inner wall 42 of jacket 40 is provided with an inwardly extending annular bulge 49 just above inlet 46. The purpose of bulge 49 is to constrict the flow of the cooling liquid as the cooling liquid enters gap 44, to ensure that the cooling liquid flows uniformly along outer wall 18 of cylinder unit 10 towards outlet 48, thereby providing uniform cooling of cylinder unit 10. FIGS. 3A and 3B are two horizontal cross sections of the engine of FIG. 1, along section A-A, through bulge 49, showing two embodiments of bulge 49. In the embodiment of FIG. 3A, bulge 49 is circumferentially uniform. In the embodiment of FIG. 3B, bulge 49 is provided with six indentations 104. Cooling liquid entering gap 44 through inlet 46 is directed preferentially through indentations 104. The transverse cross section of FIG. 1 is along section B-B of FIGS. 3A and 3B. The longitudinal cross section of FIG. 2 is along section C-C of FIG. 3B: because section C-C cuts through two of indentations 104, bulge 49 does not appear in FIG. 2.

In FIG. 1, inner wall 42 of jacket 40 is shown in contact with outer wall 18 of cylinder unit 10, adjacent to cylinder head 12, along contact surfaces 52 and 52', with two different mechanisms shown for providing a seal between contact surfaces 52 and 52'. On the left side of FIG. 1, a gasket seal 53 provides the seal. Gasket seal 53 entirely fills the contact area, and contact surface 52 does not directly contact contact surface 52'. On the right side of FIG. 1, an o-ring seal 53' provides the seal. O-ring seal 53' fills only a portion of the contact area, and contact surfaces 52 and 52' are in direct contact adjacent to o-ring seal 53'. It should not be construed that contact surfaces 52 and 52' are preferably sealed by an o-ring seal near intake port 30 and by a gasket seal near exhaust port 34. The configuration shown in FIG. 1 is illustrative only. Either an o-ring seal or a gasket seal may be used near either port, depending on the application.

In FIG. 2 are shown spacers 54 extending radially inward from inner wall 42 to separate inner wall 42 from outer wall 18, thereby preserving the integrity of gap 44.

The Figures also illustrate four mechanisms for securing jacket 40 to cylinder unit 10 and sealing the bottom of gap 44. Two different mechanisms are illustrated on each Figure, one on the left side of the Figure and one on the right side of the Figure. It is important to note that the two mechanisms in each Figure are not necessarily mutually consistent; they are shown together only for conciseness.

The left side of FIG. 1 shows the base of jacket 40 terminating in a jacket flange 72 extending radially outward from jacket 40. Below jacket flange 72, a cylinder unit flange 70 extends radially outward from cylinder unit 10. A bolt 60 runs through a hole 76 in jacket flange 72 and a hole 78 in cylinder unit flange 70. Bolt 60 has a head 62 and a threaded part 64. Head 62 is in contact with jacket flange 72 above hole 76. A nut 66 is threaded onto threaded part 64 below hole 78 and is in contact with cylinder unit flange 70 below hole 78. Nut 66 is rotationally tightened onto bolt 60 to pull jacket flange 72 towards cylinder unit flange 70, in opposition to the resistance provided by the contact of jacket 40 and cylinder head 12 at contact surfaces 52 and 52' across seals 53 and 53'. The resulting tension secures jacket 40 onto cylinder unit 10. Gap 44 is sealed adjacent to contact surfaces 52 and 52' by the resulting compression on seals 53 and 53', and adjacent to a cylinder unit sealing flange 70' by two o-ring seals 74 in annular grooves that encircle outer wall 18 on cylinder unit sealing flange 70'. The tension provided by bolt 60 and nut 66 also accommodates the thermal expansion of cylinder unit 10 relative to jacket 40 as the engine of the Figures is operated.

The right side of FIG. 1 shows a seal below inlet 46 provided by a single o-ring seal 74', in an annular groove that encircles outer wall 18, under pressure from the contact of inner wall 42 against outer wall 18.

The left side of FIG. 2 shows an a mechanism, for securing jacket 40 to cylinder unit 10, that is similar to the mechanism shown on the left side of FIG. 1. A bolt 80, having a head 82 and a threaded part 86, is inserted through hole 76 as before. Also as before, head 82 is in contact with jacket flange 72 above hole 76. Threaded part 86 is threaded into a threaded hole 88 in cylinder unit flange 70. Bolt 80 is tightened by rotation, providing tension as before to secure jacket 40 onto cylinder unit 10. Also as before, o-ring seals 74 seal gap 44 adjacent to cylinder unit sealing flange 70'.

The right side of FIG. 2 shows a mechanism for securing jacket 40 to cylinder unit 10 using a bracket 98 adjacent to basal surface 73 of jacket flange 72 and distal surface 71 of cylinder unit sealing flange 70'. (Surface 71 is "distal" in the sense that it is the farthest surface of cylinder unit sealing flange 70' from cylinder head 12.) A bolt 90, having a head 92 and a threaded part 94, runs through hole 76 and through a hole 99 in bracket 98. Head 92 is in contact with jacket flange 72 above hole 76. A nut 96 is threaded onto threaded part 94 below hole 99, and is in contact with bracket 98 below hole 99. The compressional force provided by rotationally tightening nut 96 onto threaded part 94 pushes bracket 98 against distal surface 71, in opposition to the resistance provided by the contact of jacket 40 and cylinder head 12 at contact surfaces 52 and 52' across seals 53 and 53'. The resulting tension secures jacket 40 onto cylinder unit 10. As before, gap 44 is sealed at contact surfaces 52 and 52' by seals 53 and 53', and adjacent to cylinder unit sealing flange 70' by o-ring seals 74.

The attachment of jacket 40 to cylinder unit 10 is further secured by a nut 39 threaded onto outer wall 18 of cylinder unit 10 adjacent to the top of injector seat 38, as shown in FIG. 2. A face seal 100 in an annular groove in the base of nut 39 provides a seal between nut 39 and inner wall 42 of jacket 40. A cylindrical seal 102 in an annular groove in the inner wall of nut 39 provides a seal between nut 39 and outer wall 18 of cylinder unit 10.

While the invention has been described with respect to a limited number of embodiments, it will be appreciated that many variations, modifications and other applications of the invention may be made.

What is claimed is:

1. A reciprocating machine comprising:

(a) at least one uniblock cylinder unit including a cylinder head and a cylinder body, said at least one cylinder unit having an outer wall;

(b) a jacket, reversibly secured to said at least one cylinder unit said jacket entirely enclosing said outer wall of said at least one cylinder unit external to said cylinder head and at least partially enclosing said outer wall of said at least one cylinder unit external to said cylinder body, said jacket and said outer wall defining between them a gap;

(c) a mechanism for reversibly securing said jacket to said at least one cylinder unit under tension; and (d) at least one piston, each of said at least one piston being reciprocally and slidably mounted within one of said at least one cylinder.

2. The machine of claim 1, wherein said securing mechanism includes:

(i) a cylinder unit flange on said at least one cylinder unit;

(ii) a jacket flange on said jacket; and (iii) a bolt, extending from said cylinder unit flange to said jacket flange, whereby said cylinder unit flange is secured to said jacket flange.

3. The machine of claim 1, wherein said securing mechanism includes:

(i) a cylinder unit flange, on said at least one cylinder unit, having a distal surface;

(ii) a jacket flange on said jacket;

(iii) a bracket, placed adjacent to said distal surface of said cylinder unit flange and adjacent to said jacket flange; and (iv) a bolt, extending from said jacket flange to said bracket, whereby said jacket flange is secured to said bracket.

4. The machine of claim 1, wherein said jacket further includes an inner wall and a plurality of spacers, extending towards said cylinder unit from said inner wall, whereby said inner wall of said jacket is kept apart from said outer wall of said at least one cylinder unit.

5. The machine of claim 1, wherein said jacket further includes:

(i) a inlet port for admitting coolant to said gap; and (ii) an outlet port for discharging coolant from said gap.

6. The machine of claim 6, wherein said jacket further includes an inner wall and a substantially annular bulge, projecting inward from said inner wall, between said inlet port and said outlet port, for controlling coolant flow.

7. The machine of claim 1, wherein said jacket further includes an inner wall, the machine further comprising:

(d) a seal between a portion of said outer wall of said cylinder unit and a portion of said inner wall of said jacket.

8. The machine of claim 7, wherein said seal is a gasket seal, said outer wall of said cylinder unit and said inner wall of said jacket being separated adjacent to said gasket seal.

9. The machine of claim 7, wherein said seal is an o-ring seal, said outer wall of said cylinder unit and said inner wall of said jacket being in direct contact adjacent to said o-ring seal.

10. The machine of claim 1, wherein said jacket includes an inner wall, and wherein said tension urges a portion of said inner wall of said jacket towards a portion of said outer wall of said at least one cylinder unit external to said cylinder head.

11. The machine of claim 10, further comprising:

(d) a seal between said portion of said outer wall of said cylinder unit external to said cylinder head and said portion of said inner wall of said jacket.

12. The machine of claim 11, wherein said seal is a gasket seal, said outer wall of said cylinder unit and said inner wall of said jacket being separated adjacent to said gasket seal.

13. The machine of claim 11, wherein said seal is an o-ring seal, said outer wall of said cylinder unit and said inner wall of said jacket being in direct contact adjacent to said o-ring seal.

14. In a reciprocating machine having at least one uniblock cylinder unit including a cylinder head and a cylinder body, the at least one cylinder unit having an outer wall and a cylinder unit flange, each of the at least one cylinder unit having a piston reciprocally and slidably mounted therewithin: the combination with the machine of:

(a) a jacket, reversibly secured to the at least one cylinder unit, said jacket entirely enclosing the outer wall of the at least one cylinder unit external to the cylinder head and at least partially enclosing the outer wall of the at least one cylinder unit external to the cylinder body, said jacket and the outer wall defining between them a gap; and (b) a mechanism for reversibly securing said jacket to said at least one cylinder unit under tension.

15. The machine of claim 14, wherein said securing mechanism includes:

(i) a jacket flange on said jacket; and (ii) a bolt, extending from the cylinder unit flange to said jacket flange, whereby the cylinder unit flange is secured to said jacket flange.

16. The machine of claim 14, wherein said jacket further includes an inner wall and a plurality of spacers, extending inward from said inner wall, whereby said inner wall of said jacket is kept apart from the outer wall of the at least one cylinder unit.

17. The machine of claim 14, wherein said jacket further includes:

(i) an inlet port for admitting coolant to said gap; and (ii) an outlet port for discharging coolant from said gap.

18. The machine of claim 17, wherein said jacket further includes an inner wall and a substantially annular bulge, projecting inward from said inner wall, between said inlet port and said outlet port, for controlling coolant flow.

19. The machine of claim 14, wherein said jacket further includes an inner wall, the machine further comprising a seal between a portion of the outer wall of the cylinder unit and a portion of said inner wall of said jacket.

20. The machine of claim 19, wherein said seal is a gasket seal, the outer wall of the cylinder unit and said inner wall of said jacket being separated adjacent to said gasket seal.

21. The machine of claim 19, wherein said seal is an o-ring seal, the outer wall of the cylinder unit and said inner wall of said jacket being in direct contact adjacent to said o-ring seal.

22. The machine of claim 14, wherein said jacket includes an inner wall, and wherein said tension urges a portion of said inner wall of said jacket towards a portion of the outer wall of the at least one cylinder unit external to the cylinder head.

23. The machine of claim 22, further comprising:

(c) a seal between said portion of the outer wall of the cylinder unit external to the cylinder head and said portion of said inner wall of said jacket.

24. The machine of claim 23, wherein said seal is a gasket seal, the outer wall of the cylinder unit and said inner wall of said jacket being separated adjacent to said gasket seal.

25. The machine of claim 23, wherein said seal is an o-ring seal, the outer wall of the cylinder unit and said inner wall of said jacket being in direct contact adjacent to said o-ring seal.

26. In a reciprocating machine having at least one uniblock cylinder unit including a cylinder head and a cylinder body, the at least one cylinder unit having an outer wall and a cylinder unit flange, the cylinder unit flange having a distal surface, each of the at least one cylinder unit having a piston reciprocally and slidably mounted therewithin: the combination with the machine of;

(a) a jacket, reversibly secured to the at least one cylinder unit, said jacket entirely enclosing the outer wall of the at least one cylinder unit external to the cylinder head and at least partially enclosing the outer wall of the at least one cylinder unit external to the cylinder body, said jacket and the outer wall defining between them a gap, and (b) a mechanism for reversibly securing said jacket to said at least one cylinder unit under tension.

27. The machine of claim 26, wherein said securing mechanism includes:

(i) a jacket flange on said jacket;

(ii) a bracket, placed adjacent to the surface of the cylinder unit flange and adjacent to said jacket flange; and (iii) a bolt, extending from said jacket flange to said bracket, whereby said jacket flange is secured to said bracket.

28. The machine of claim 26, wherein said jacket further includes an inner wall and a plurality of spacers, extending inward from said inner wall, whereby said inner wall of said jacket is kept apart from the outer wall of the at least one cylinder unit.

29. The machine of claim 26, wherein said jacket further includes:

(i) an inlet port for admitting coolant to said gap; and (ii) an outlet port for discharging coolant from said gap.

30. The machine of claim 29, wherein said jacket further includes an inner wall and a substantially annular bulge, projecting inward from said inner wall, between said inlet port and said outlet port, for controlling coolant flow.

31. The machine of claim 26, wherein said jacket further includes an inner wall, the machine further comprising a seal between a portion of the outer wall of the cylinder unit and a portion of said inner wall of said jacket .

32. The machine of claim 31, wherein said seal is a gasket seal, the outer wall of the cylinder unit and said inner wall of said jacket being separated adjacent to said gasket seal.

33. The machine of claim 31, wherein said seal is an o-ring seal, the outer wall of the cylinder unit and said inner wall of said jacket being in direct contact adjacent to said o-ring seal.

34. The machine of claim 26, wherein said jacket includes an inner wall, and wherein said tension urges a portion of said inner wall of said jacket towards a portion of the outer wall of the at least one cylinder unit external to the cylinder head.

35. The machine of claim 34, further comprising:

(c) a seal between said portion of the outer wall of the cylinder unit external to the cylinder head and said portion of said inner wall of said jacket.

36. The machine of claim 35, wherein said seal is a gasket seal, the outer wall of the cylinder unit and said inner wall of said jacket being separated adjacent to said gasket seal.

37. The machine of claim 35, wherein said seal is an o-ring seal, the outer wall of the cylinder unit and said inner wall of said jacket being in direct contact adjacent to said o-ring seal.

* * * * *